United States Patent [19]

Henke

[11] Patent Number: 4,998,763

[45] Date of Patent: Mar. 12, 1991

[54] CARGO HOOK

[76] Inventor: James A. Henke, 10300 Albion Road, Richmond, B.C., Canada, V7A 3E4

[21] Appl. No.: 381,823

[22] Filed: Jul. 19, 1989

[30] Foreign Application Priority Data

Jul. 21, 1988 [CA] Canada ..... 572730

[51] Int. Cl.[5] ..... B66C 1/34

[52] U.S. Cl. ..... 294/82.33; 294/75; 294/82.26

[58] Field of Search ..... 294/75, 82.11, 82.14, 294/82.24–82.27, 82.3, 82.31, 82.33, 82.34, 82.36; 24/232 R, 233, 241 P, 241 PP, 241 SP, 241 SB

[56] References Cited

U.S. PATENT DOCUMENTS

| | | | |
|---|---|---|---|
| 706,248 | 8/1902 | Merches | 294/82.33 |
| 870,593 | 11/1907 | Sprogis | 294/82.33 |
| 1,030,586 | 6/1912 | Irwin | 294/82.33 |
| 1,224,148 | 5/1917 | Crosby | 294/75 |
| 3,239,266 | 3/1966 | Elliott | 294/82.33 |
| 3,575,459 | 4/1971 | Coblenz | 294/82.33 X |
| 3,633,960 | 1/1972 | Drayton | 294/82.36 X |
| 4,061,103 | 12/1977 | Mampaey | 294/82.27 X |
| 4,618,179 | 10/1986 | Mampaeij | 294/82.31 |

FOREIGN PATENT DOCUMENTS

| | | | |
|---|---|---|---|
| 910904 | 11/1962 | United Kingdom | 294/82.27 |

*Primary Examiner*—Johnny D. Cherry
*Attorney, Agent, or Firm*—Shlesinger & Myers

[57] ABSTRACT

A cargo hook for releasably carrying a load includes a support frame, a load beam and latching mechanism for releasably engaging the beam in a load secured position. The latching mechanism includes a contact roller carried by the beam and an interference shaft rotatably mounted to the frame. In the load secured position, the roller abuts the interference shaft. Load release occurs when the interference shaft is rotated to a position which permits the load beam to pivot downwardly past the shaft.

6 Claims, 4 Drawing Sheets

(DETAIL A)

CARGO HOOK

FIELD OF THE INVENTION

This invention relates to a cargo hook for releasably carrying a load. While the hook may be used in a variety of applications, it is considered particularly suitable for airborne applications.

DESCRIPTION OF THE PRIOR ART

With the advent of helicopter logging and other airborne applications, there has developed a need for cargo hooks that can not only secure and carry a load, but which can also reliably release a load—and do so quickly if the need arises. In emergency situations, the ability to effect a rapid, reliable release can be crucial. Otherwise disasterous consequences may follow.

A variety of designs exist for airborne cargo hooks that can releasably carry a load. For example, U.S. Pat. No. 4,572,563 to Fontana discloses an electrical switching system which depends upon the energization of an electromagnet to release a pawl and tooth engagement that holds a hook in a closed position. However, the mechanical linkage disclosed requires a number of parts. Further, as disclosed, disengagement is not possible if the electromagnet is energized when the hook is under load. This is stated to be an advantage in that it guards against an untimely release before a load is rested on the ground. However, it works against an emergency release while the load is in the air.

U.S. Pat. No. 4,095,833 to Lewis discloses a pneumatic controlled hook release system which controls a piston rod that also serves as a latch pin and linearly engages a recess of a hook when the hook is under load. Such an arrangement is considered undesirable for a number of reasons. Firstly, the piston is prone to a relatively high degree of wear and possible breakage. Secondly, there is a possiblity that the piston rod will jam or bind—and it appears that disengagement of a load could not be easily accomplished, if at all, when the hook is under load. Thirdly, the hook as disclosed by Lewis must be manually returned to its secured position following the release of a load.

SUMMARY OF THE INVENTION

In accordance with a broad aspect of the present invention there is provided a cargo hook for releasably carrying a load, the cargo hook comprising a support frame, a load beam for releasably engaging and carrying the full weight of the load, and a latching means for releasably engaging the beam in its secured position. The load beam is pivotally mounted between opposed sides of the frame for pivotal movement about a beam axis between a first position at which the load is secured by the hook and a second position at which the load is released by the hook.

The latching means comprises a contact roller carried by the load beam and an interference shaft rotatably mounted between opposed sides of the support frame. The axes of rotation of the contact roller and the interference shaft both extend parallel to the beam axis. The interference shaft is rotatable between a first position at which the shaft abuts the contact roller along a line of abutment thereby securing the load beam against pivotal movement, and a second position at which the load beam is free to pivot downwardly past the shaft to permit release of the load.

In a preferred embodiment of the present invention, the interference shaft has a substantially semicircular cross-section over that portion of its length which provides abutment with the contact roller. The line of abutment lies at an angle of about 45° with respect to the beam axis relative to a plane containing the roller axis and the shaft axis. Abutment contact occurs when the circular side of the shaft is turned towards the roller. When turned away, no such contact occurs and there is no element to block or interfere with downward pivotal movement of the load beam.

When the hook is under a load, significant forces are transmitted to the interference shaft across the line of abutment with the contact roller. However, these forces are axially directed between the shaft and the roller. Thus, even when the hook is under load, it is relatively easy to rotate the interference shaft (with commensurate rotation of the contact roller) to the point where the beam is free to pivot past the shaft.

It will be appreciated that the foregoing calls for only three moving parts in the hook assembly per se, namely: the load beam, the contact roller, and the interference shaft. All of these parts, as well as the support frame, may be made very rugged in construction. As well, it will be appreciated that the operation of the hook requires only rotational movement of the parts and rolling or abutment contact between the parts. There is no linear motion which may lead to increased complexity of design or added wear and tear.

Advantageously, a cargo hook in accordance with the present invention may be biased in a load secured position by a biasing means (such as an elastic bungee cord) connected between the load beam and the support frame.

In a preferred embodiment of the present invention, the load beam includes an elongated opening extending parallel to the sides of the support frame and which is shaped to slidingly receive the ferruled end of a load strap. The beam includes parallel spaced rails for engaging the underside of the ferruled end on opposed sides of the strap. Preferably the opening is configured such that forces transmitted downwardly on the rails tend to draw the rails together—thereby providing a more reliable engagement of the load.

The invention will now be described with reference to the detailed embodiment shown in the drawings.

DETAILED DESCRIPTION

Figure 2:
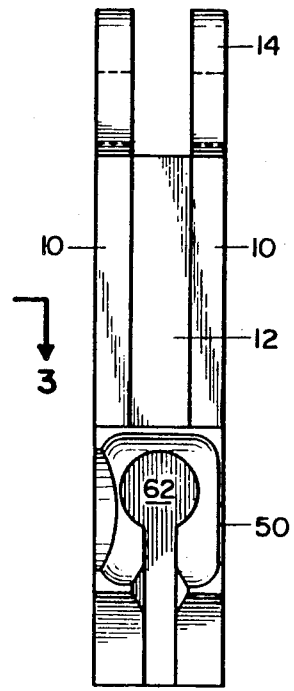
FIG. 2 is an end elevation view of the cargo hook shown in FIG. 1, as seen from the right.

The cargo hook shown in the FIGS. 1 to 8 includes a load beam generally designated 50 pivotally mounted between opposed sides or carrier plates 10 of a support frame generally designated 8. Frame 8 also includes a spacer plate 12 which is installed between plates 10 to maintain their separation. When assembled, frame 8 is held together by four bolts (not shown) located through holes 13. Upper portion 14 of frame 8 includes a bolt hole 16 to enable the entire frame to be secured to the lifting frame of a helicopter or the like.

Load beam 50 is mounted to frame 8 on a pivot pin 52 which extends between plates 10, and which provides a pivot axis designated 54. Normally, beam 50 is pivotally biased to the load secured position shown in FIG. 1. However, as is described below, it can be allowed to pivot clockwise to the load release position shown in FIG. 4.

Pivotal biasing of beam 50 is achieved by means of an elastic or bungee cord 80 attached at one end to spacer plate 12 by a retainer 82 bolted to the plate, and at its opposite end to a pivot connection 84 carried by the beam. Cord 80 is stretched and threaded over a pair of pulleys 86, each of which pulleys is pivotally mounted between carrier plates 10. The resulting biasing force pulls load beam 50 counterclockwise, and is sufficient to restrain pivotal movement of the beam under its own weight. However, under the weight of any significant external load, the bias gives way and allows beam 50 to pivot clockwise.

It may be noted that an end 88 of cord 80 protrudes slightly past retainer 82. This provides an abutment or stop that softens the impact and contact of beam 50 with frame 8 when the cord pulls the beam to its normally closed condition.

A contact roller 20 is mounted to load beam 50 by a pivot pin 22, and has an axis of rotation indicated by 24. Roller 20 is positioned such that in the load secured position (FIG. 1) it may move into abutment with an interference shaft 30, the latter of which is rotatably mounted between plates 10, and which has an axis of rotation 32 that extends parallel to roller axis 24.

Figure 7:
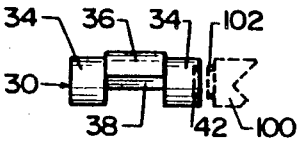
FIG. 7 is a lengthwise elevation view of the interference shaft forming part of the cargo hook shown in FIG. 1.

Interference shaft 30, shown lengthwise in FIG. 7, has cylindrical end portions 34 and a central portion 36 which is substantially semi-circular in cross-section. (Central portion 36 is not completely semi-circular because a relief area 38, referred to below, is cut in the shaft).

Figure 1:
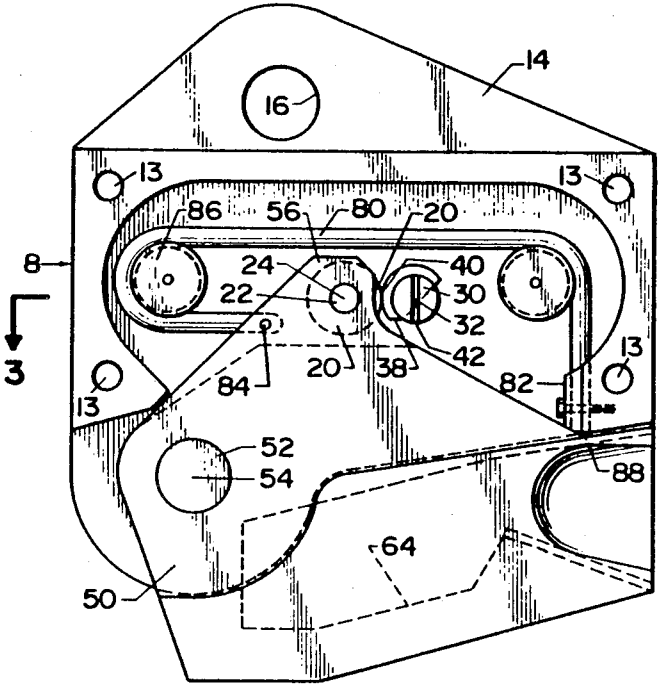
FIG. 1 is a side elevation view of a cargo hook in accordance with the present invention, one of its side carrier plates having been removed for purposes of illustration.
Figure 3:
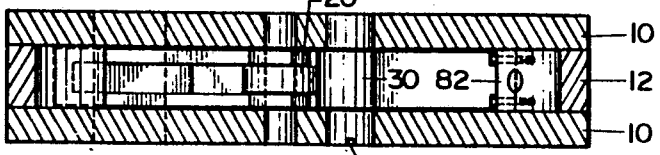
FIG. 3 is a top view of the cargo hook shown in FIG. 1, taken along line 3—3 in FIG. 1, part of the assembly in FIG. 1 having been removed for purposes of illustration.

Whether contact roller 20 abuts shaft 30 depends upon the angular position of shaft 30. As shown in FIG. 1, cylindrical side 40 of the central portion of shaft 30 is turned towards and abuts roller 20 in the load secured position. Clockwise rotation of beam 50 is thereby blocked. However, if shaft 30 is turned 90° clockwise from the position shown in FIG. 1 to the position shown in FIG. 4, roller 20 being concurrently driven 90° counterclockwise, then beam 50 can pivot clockwise past the shaft to the load release position shown in FIG. 4.

When a load is secured, and the cargo hook is in a normally upright position as shown in FIG. 1, roller axis 24, shaft axis 32, and the line of abutment between the roller and the shaft will lie in a common horizontal plane. Measured from this plane, such line of abutment lies at an angle of about 45° with respect to beam axis 54.

It will be appreciated that significant load forces can be transmitted from contact roller 20 across the line of abutment to interference shaft 30 when beam 50 is under load. However, since these forces are axially directed between roller 20 and shaft 30, the ease with which the shaft may be rotated is largely a function of bearing friction on the roller and the shaft. The net result is that relatively little force is required to rotate shaft 30 when beam 50 is under load.

As can be seen in FIG. 1, only a relatively small portion of the leading edge periphery of contact roller 20 is exposed for contact with shaft 30. Otherwise, it is housed between opposed upper sides 56 of beam 50. This is a fail safe feature which acts to maintain a load in a secured position in the event that roller pivot pin 22 shears. If such a shear occurs, beam 50 will pivot forwardly, but only a small degree until the leading edges 58 of upper sides 56 engage shaft 30.

Ninety degree rotation of shaft 30 from the load secured position (FIG. 1) to the load release position (FIG. 4) may be accomplished by various means. To facilitate mechanical engagement, shaft 30 is provided with a key slot or groove joint 42 which, as best indicated in FIG. 7, is designed to receive an engaging key or tongue 102 of an externally controlled actuator 100. The particular actuator mechanism utilized is not considered to be part of the invention, but may be as simple as a manually controlled lever, or a more sophisticated mechanism that relies upon electrical, gas or hydraulic operation. In some airborne applications, a manual lever may be considered desirable in addition to any other mechanism that may be utilized, the purpose being to maintain control in the event of mechanical or electrical failure.

Figure 4:
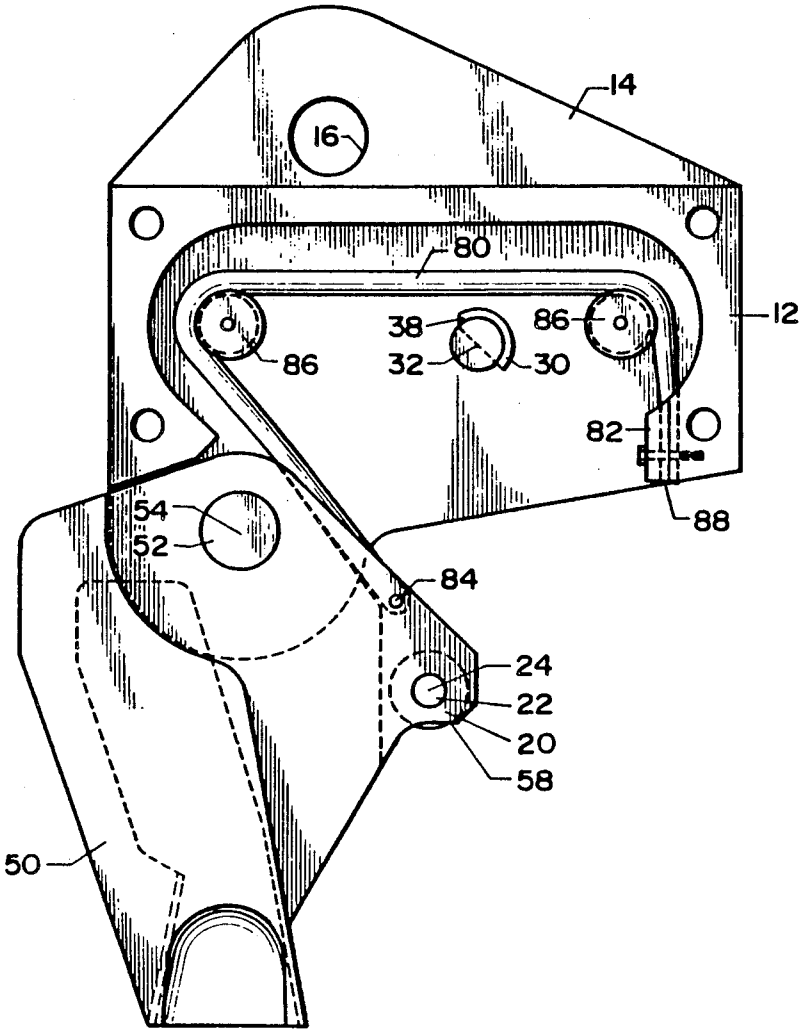
FIG. 4 is a side elevation view of the cargo hook shown in FIG. 1, when in an open condition.

When cord 80 returns beam 50 to the load secured position (FIG. 1) from the load release position (FIG. 4), the beam will not engage shaft 30 if the shaft has remained in the position shown in FIG. 4. In some cases, however, it is contemplated that the external actuating mechanism may include provision for biasing shaft 30 to the position shown in FIG. 1. If so, then the returning beam will strike the shaft causing a clockwise rotation of the shaft against such bias. Relief area 38 of the shaft provides a flat surface area (as opposed to a sharp semi-cylindrical edge) on which the strike can occur.

Figure 5:
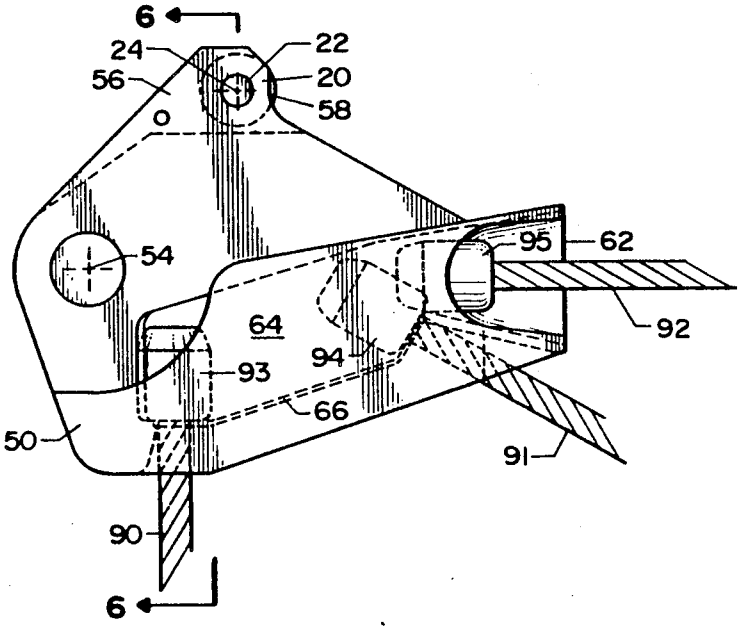
FIG. 5 is a side elevation view of the load beam forming part of the cargo hook in FIG. 1.
Figure 8:
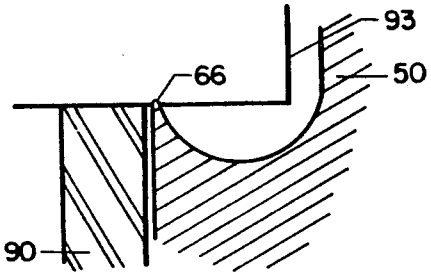
FIG. 8 is a cross-section view of detail A in FIG. 6.
Figure 6:
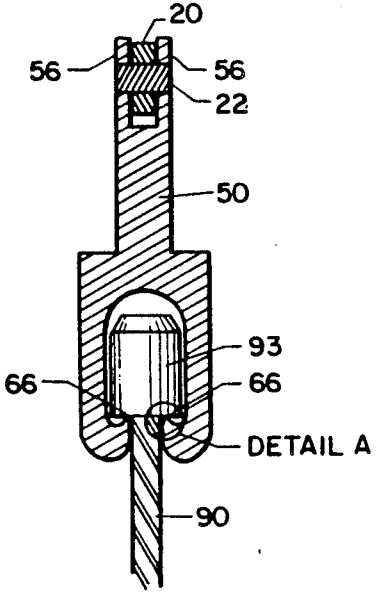
FIG. 6 is an elevation view of the load beam shown in FIG. 5, as seen along line 6—6 in FIG. 5.

As is best shown in FIGS. 5 and 6, load beam 50 is particularly adapted to receive and engage load straps or cables 90, 91, 92, each cable including a ferruled end 93, 94, 95. In FIG. 5, cable 90 is shown fully received and engaged in cavity 64 of the beam. This same cable is shown in FIG. 6 where it will be observed that parallel rails 66 of beam 50 have engaged the underside of ferruled end 93 on opposed sides of the cable. This engagement is designed such that the downwardly acting force of the ferrule under the weight of an external load (not shown) tends to draw rails 66 together rather than tending to spread them apart. In FIG. 5, cable 91 is shown having been received just past circular opening 62 (see FIG. 2) into cavity 64. As can be seen, cable 91 will naturally tend to slide to the left in FIG. 5 until it abuts cable 90. Ferruled end 95 of cable 92 is shown just passing into cavity 64 through opening 62, and will slide to abutment with cable 91 when completely received.

Normally, cables such as cables 90, 91, 92 will be coupled to load beam 50 in the manner indicated when the beam is in the load secured position. They will remain engaged when the cargo hook is lifted. However, when the beam is released and swings down 90° to the load release position, the cables simply slide and drop out of the beam.

Figure 9:
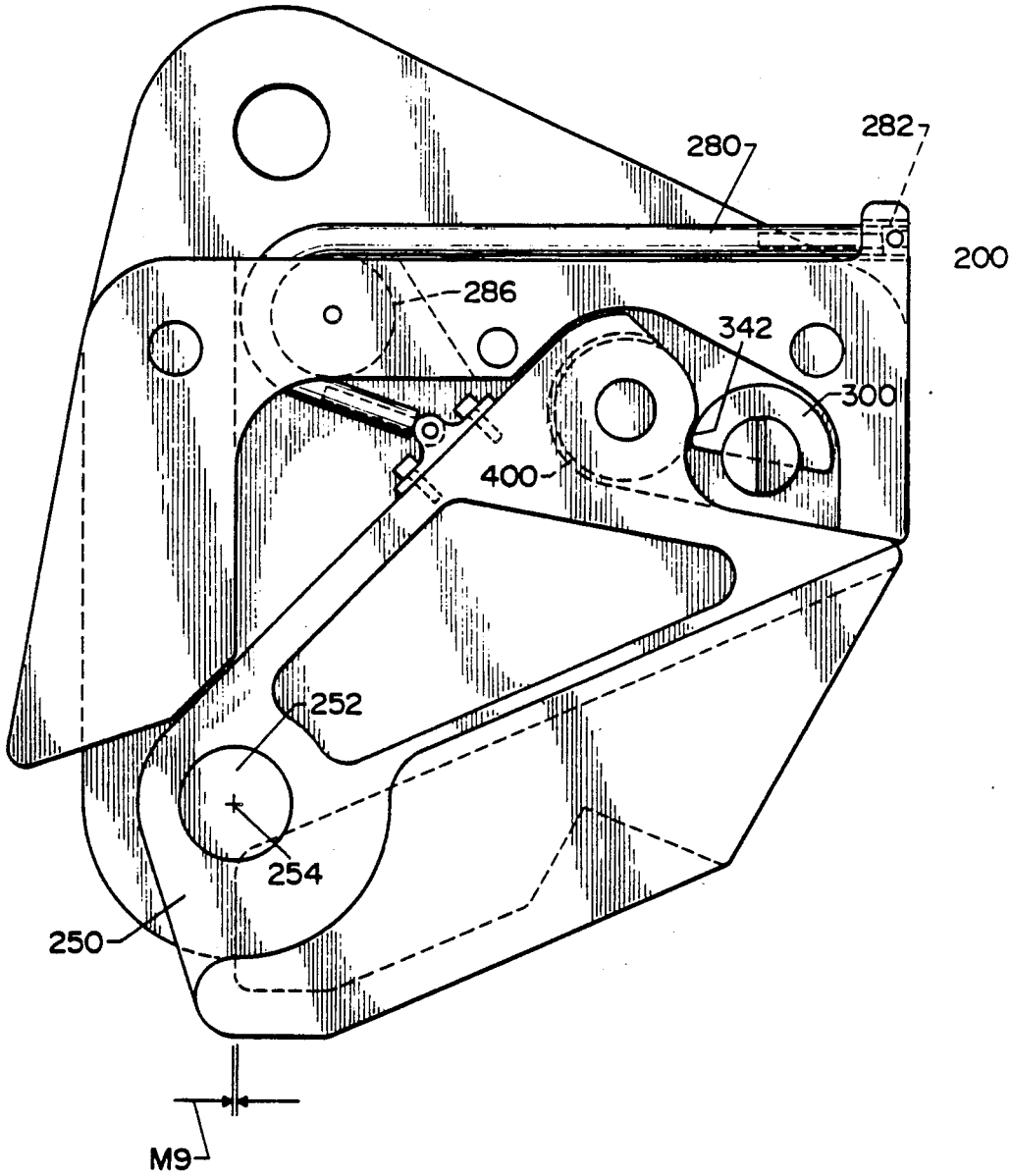
FIG. 9 is a side elevation view of another cargo hook in accordance with the present invention.

The cargo hook shown in FIG. 9 embodies many of the same features as that shown in FIGS. 1 to 8, but there are a number of differences that may be observed.

Firstly, however, it should be noted that a cargo hook like that shown in FIG. 1 when designed for a rated load of about 30,000 pounds was found to begin elastic deformation at about 75,000 pounds and, ultimately, to fracture at about 145,000 pounds. The point of fracture was the contact roller. To put this in perspective, the overall dimensions of the hook were about 15½ inches high by 12⅜ inches long by 2¾ inches thick. The contact roller was fabricated from 4140 CRMB chrome molybdenum steel heat-treated to a Rockwell C hardness of about 54, and had a diameter of about 1¾ inches. The interference shaft had a diameter of about 1¼ inches. The foregoing destructive test results were considered to be very good. However, redesign is taking place with the primary objective of having a fracture point in excess of 150,000 pounds for a rated load of about 30,000 pounds. The cargo hook illustrated in FIG. 9 has evolved from the process of redesign. However, it is emphasized here that actual destructive testing has not yet taken place, and it cannot be confirmed at this time that the evolved design represented by FIG. 9 will exhibit improved destructive test characteristics. A computer simulation has suggested that it will, but this is simply a simulation. In any case, however, the cargo hook of FIG. 9 does represent an alternate embodiment of the present invention.

In the cargo hook of FIG. 9, it will be noted that the biasing arrangement for holding beam 250 in a closed position differs from that of the cargo hook shown in FIG. 1. Only one pulley 286 is used, an elastic cord 280 being routed around the back of the pulley to a retainer 282 positioned at the top front edge of carrier plate 200. There is no pulley lying in advance of contact roller 400 and interference shaft 300 as in the case of roller 20 and shaft 30 in the case of the cargo hook in FIG. 1. This difference effectively opens up space within the cargo hook housing which enables the diameter of the contact roller and interference shaft to be enlarged and at the same time have these elements distanced relatively further away from beam pivot axis 254, the latter of which leads to an increased mechanical advantage about pivot pin 252. Concurrently, the moment arm measured by distance M1 in FIG. 1 and distance M9 in FIG. 9, being the distance between the axis of the pivot pin and the line of force through which an external load will act, has been relatively reduced (compared to the cargo hook FIG. 1) in the case of the cargo hook shown in FIG. 9.

It may also be noted that interference shaft 300 in FIG. 9 has a rounded relief edge 342 rather than a flat relief 38 as in the case of shaft 30 in FIG. 1. Such rounded relief still avoids an undesirable sharp edge as discussed with reference to the embodiment in FIG. 1.

It is to be understood that various changes can be made to the form, details, arrangement and proportion of the various parts described with reference to the foregoing embodiments without departing from the scope of the present invention. The invention is not to be construed as limited to the particular embodiments described.

I claim:

1. A cargo hook for releasably carrying a load, said cargo hook comprising:
   (a) a support frame;
   (b) a load beam releasably engaging and carrying the full weight of said load, said beam pivotally mounted between opposed sides of said frame for pivotal movement about a beam axis between a first position at which said load is secured by said hook and a second position at which said load is released by said hook; and,
   (c) latching means for releasably engaging said beam in said secured position, said latching means comprising
      (i) a contact roller carried by said beam and rotatable about a roller axis extending parallel to said beam axis; and,
      (ii) an interference shaft rotatably mounted between said sides for rotation about a shaft axis extending parallel to said beam axis and said roller axis, said shaft being rotatable between a first position at which said shaft abuts said contact roller along a line of abutment thereby securing said beam against pivotal movement, and a second position at which said beam is free to pivot downwardly past said shaft to permit release of said load.

2. A cargo hook as defined in claim 1 wherein, said shaft has a substantially semi-circular cross-section over that portion of its length which provides abutment with said roller.

3. A cargo hook as defined in claim 2, further including biasing means connected between said beam and said frame for biasing said beam in said secured position.

4. A cargo hook as defined in claim 1, 2 or 3 wherein, said contact roller is housed between opposed upper sides of said load beam such that a relatively small portion of the leading edge periphery of said roller is exposed for contact with said shaft.

5. A cargo hook as defined in claim 1, 2 or 3 wherein said beam and said shaft each rotate about 90° upon release of said load.

6. A cargo hook as defined in claim 1 wherein, said load beam includes an elongated opening extending parallel to said sides and which is shaped to slidingly receive a ferruled end of a load strap, said beam including parallel spaced rails for engaging the underside of said ferruled end on opposed sides of said strap when so received.

* * * * *